US010844451B2

(12) United States Patent
Zhang et al.

(10) Patent No.: US 10,844,451 B2
(45) Date of Patent: Nov. 24, 2020

(54) HIGH MAGNETIC INDUCTION AND LOW IRON LOSS NON-ORIENTED ELECTRICAL STEEL SHEET WITH GOOD SURFACE STATE AND MANUFACTURING METHOD THEREFOR

(71) Applicant: BAOSHAN IRON & STEEL CO., LTD., Shanghai (CN)

(72) Inventors: Feng Zhang, Shanghai (CN); Bo Wang, Shanghai (CN); Yanli Song, Shanghai (CN); Xuejun Lv, Shanghai (CN); Aihua Ma, Shanghai (CN); Changguo Huang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 394 days.

(21) Appl. No.: 15/559,042

(22) PCT Filed: Dec. 8, 2015

(86) PCT No.: PCT/CN2015/096635
§ 371 (c)(1),
(2) Date: Sep. 16, 2017

(87) PCT Pub. No.: WO2016/150195
PCT Pub. Date: Sep. 29, 2016

(65) Prior Publication Data

US 2018/0094331 A1 Apr. 5, 2018

(30) Foreign Application Priority Data

Mar. 20, 2015 (CN) ..... 2015-1-0125521

(51) Int. Cl.
*C21D 8/12* (2006.01)
*C22C 38/06* (2006.01)
(Continued)

(52) U.S. Cl.
CPC ..... *C21D 8/12* (2013.01); *C22C 38/06* (2013.01); *C22C 38/14* (2013.01); *H01F 1/147* (2013.01)

(58) Field of Classification Search
None
See application file for complete search history.

(56) References Cited

U.S. PATENT DOCUMENTS

2013/0056167 A1* 3/2013 Zhang ..... C22C 33/04 164/56.1
2015/0000794 A1 1/2015 Liang et al.
(Continued)

FOREIGN PATENT DOCUMENTS

CN 102134675 A 7/2011
CN 102796948 A * 11/2012
(Continued)

OTHER PUBLICATIONS

Machine translation of CN102796948. (Year: 2012).*
(Continued)

*Primary Examiner* — Xiaowei Su
(74) *Attorney, Agent, or Firm* — Thomas Horstemeyer, LLP

(57) ABSTRACT

Disclosed is a non-oriented electrical steel plate having a good surface state, a high magnetic induction and a low iron loss, the contents of various chemical elements of the non-oriented electrical steel plate in mass percentage being: $0<C\leq0.004\%$, $0.1\%\leq Si\leq1.6\%$, $0.1\%\leq Mn\leq0.8\%$, $0.1\%\leq Al\leq0.6\%$, $Ti\leq0.0015\%$, and the balance being Fe and other inevitable impurities, with $0.2\%\leq(Si+Al)\leq2.0\%$ being met. Also disclosed is a method for manufacturing the above-mentioned steel plate, comprising the steps: a liquid iron pretreatment, smelting with a converter, RH refining, casting into slabs, hot rolling, acid pickling, cold rolling, annealing and coating. The non-oriented electrical steel
(Continued)

plate of the present invention has an excellent magnetic property, an ultralow iron loss and a higher steel purity; in addition the surface quality of the steel plate is good and the production cost is low.

5 Claims, 2 Drawing Sheets

(51) Int. Cl.
*C22C 38/14* (2006.01)
*H01F 1/147* (2006.01)

(56) References Cited

U.S. PATENT DOCUMENTS

| | | | | |
|---|---|---|---|---|
| 2015/0013844 | A1* | 1/2015 | Xie | C21C 7/068 148/111 |
| 2015/0034212 | A1 | 2/2015 | Zhang et al. | |

FOREIGN PATENT DOCUMENTS

| | | | | |
|---|---|---|---|---|
| CN | 103388106 | | 11/2013 | |
| CN | 103388106 | A | 11/2013 | |
| CN | 104789862 | A | 7/2015 | |
| EP | 2623626 | | 8/2013 | |
| EP | 2824192 | | 1/2015 | |
| EP | 2826882 | | 1/2015 | |
| EP | 2832888 | | 2/2015 | |
| JP | 2005179710 | A | 7/2005 | |
| JP | 2005298846 | | 10/2005 | |
| JP | 2013527318 | A | 6/2013 | |
| KR | 20130025383 | | 3/2013 | |
| KR | 20140123582 | | 10/2014 | |
| WO | 2012087045 | A2 | 6/2012 | |
| WO | WO-2013127048 | A1 * | 9/2013 | C12C 7/068 |

OTHER PUBLICATIONS

Machine translation of CN 103388106A. (Year: 2013).*
Japanese Office Action dated Jan. 8, 2019 for Japanese Patent Application No. 2017-548380.
European Search Report dated Oct. 12, 2018 for European Patent Application No. 15886117.9 filed Dec. 8, 2015.
Korean Office Action dated Dec. 4, 2018 for Korean Patent Application No. 9-5-2018-083243218.
PCT/CN2015/096635 International Search Report and Written Opinion, dated Mar. 2, 2016.
Japanese Office Action dated Sep. 11, 2018 in co-pending Japanese Patent Application No. 2017-0548380 filed Dec. 8, 2015.

* cited by examiner

HIGH MAGNETIC INDUCTION AND LOW IRON LOSS NON-ORIENTED ELECTRICAL STEEL SHEET WITH GOOD SURFACE STATE AND MANUFACTURING METHOD THEREFOR

CROSS-REFERENCE TO RELATED APPLICATIONS

This application is a 371 U.S. National Phase of PCT International Application No. PCT/CN2015/096635, filed on Dec. 8, 2015, which claims benefit and priority to Chinese patent application No. 201510125521.4, filed on Mar. 20, 2015. Both of the above-referenced applications are incorporated by reference herein in their entirety.

TECHNICAL FIELD

The invention relates to a steel plate and a method for manufacturing the same, in particular to a non-oriented electrical steel plate and a method for manufacturing the same.

BACKGROUND ART

In recent years, the reasons why electric devices such as efficient EI iron cores, electric motors, small-sized transformers become more and more popular lie in that these electric devices meet requirements of being environmentally friendly and energy-saving as well as an effective reduction of carbon dioxide emission. In addition, with the continuous improvement of the comprehensive performances of these electric devices, it is accordingly required that a non-oriented electrical steel plate, as a raw material further, needs to have an excellent magnetic property in cases of ensuring the cost advantage, that is to say, the non-oriented electrical steel plate for manufacturing the above-mentioned electric devices needs to have properties of an ultralow iron loss and an ultrahigh magnetic induction so as to satisfy the development tendency that the electric devices is adapted to being environmentally friendly, energy-saving and efficient.

In order obtain a good electromagnetic performance, the contents of silicon and aluminium in the steel will be generally increased to a great extent, so as to effectively improve the electrical resistivity of the material, thus effectively reducing the iron loss of a finished steel plate and improving the magnetic induction of the finished steel plate. In addition, electromagnetic stirring is further required to improve the slab equiaxial crystal ratio so as to obtain a finished steel plate having a good surface state, or intermediate annealing is performed using a normalizing furnace or bell furnace, so as to avoid corrugated defects which tends to be produced in the steel plate surface, thus preventing the steel plate from affecting the appearance and use of a terminal product. However, the process steps, especially the intermediate annealing using a normalizing furnace or bell furnace, not only will significantly increase the manufacturing cost of the finished steel plate, and prolongs the production time and delivery cycle of the finished steel plate, but also will bring about greater difficulties for the production management and quality management.

Chinese patent document with a publication number CN 1888112 A, published on Jan. 3, 2007, and entitled "High magnetic induction and high grade non-orientation electrical steel and its making process" discloses an electrical steel and a process for manufacturing the same. Various chemical components of the electrical steel in weight percentage are:

C≤0.0050%, N≤0.0030%, Si: 1.50-2.50%, Al: 0.80-1.30%, Mn: 0.20-0.50%, P≤0.030%, S≤0.005%, Sb: 0.03-0.10%, Sn: 0.05-0.12%, B: 0.0005-0.0040%, and the other being Fe and other inevitable impurities, wherein one of Sb and Sn is added. The technical solution is: rolling in a rough rolling pass at a high reduction ration and rough roller rolling, high temperature coiling, and optimization of the reduction ratio in each pass to obtain an ideal hot-rolled strip steel structure and improvement of the cold rolling reduction ratio to provide a greater energy (deformation energy) for the grain growth in the annealing process of final recrystallization; and by the measures, such as controlling the recrystallization annealing temperature to obtain an ideal grain structure, a steel having an excellent surface quality, a high magnetic induction, a low iron loss and being most suitable for efficient motor iron cores are obtained.

Chinese patent document with a publication number of CN 101492786 A, published on Jul. 29, 2009, and entitled "Method for producing non-oriented silicon steel" relates to a method for production of a non-oriented silicon steel. The method comprises smelting with an electric furnace, a converter or a medium-frequency induction furnace, and then continuous casting, the pulling rate being low when the silicon content is large; hot rolling; hot rolls processed by hot rolling being subjected to heat preservation with a cover, acid pickling derusting, a normalizing heat treatment, slowly heating and cooling, with the heat preservation period being 1-3 h; the hot rolls being subjected to one-time cold rolling, degreasing or surface oil removal, and unwinding to reduce the tension; and recrystallization annealing or decarbonization in a bell furnace at an annealing temperature of 750-1150° C. and for a heat preservation period of 1-80 h, with hydrogen protection being used when annealing and the dew point being ≤60° C., and then applying an insulation coating, hot stretching and temper rolling.

Chinese patent document with a publication number of 102453837 A, published on May 16, 2012, and entitled "MANUFACTURE PROCESS OF NON-ORIENTED SILICON STEEL WITH HIGH MAGNETIC INDUCTION" discloses a non-oriented silicon steel with a high magnetic induction. The method for manufacturing the non-oriented silicon steel with a high magnetic induction comprises the following steps: 1) smelting and casting, wherein the chemical composition of the non-oriented silicon steel in weight percentage is: Si: 0.1-1%, Al: 0.005-1%, C≤0.004%, Mn: 0.10-1.50%, P≤0.2%, S≤0.005%, N≤0.002%, Nb+V+Ti≤0.006%, with the balance being iron, and steel-making and secondary refining and casting into cast slabs; 2) hot rolling, wherein the heating temperature is 1150-1200° C., the final rolling temperature is 830-900° C., and the coiling is performed at a temperature of ≥570° C.; 3) temper rolling, cold rolling at a rolling reduction ratio of 2-5%; 4) normalizing, wherein the temperature is not lower than 950° C., and the heat preservation time is 30-180 s; 5) acid pickling, and cold rolling, wherein after the acid pickling, cold rolling is performed with a cumulative reduction ratio of 70-80%; and 6) annealing, wherein the temperature rises to 800-1000° C. at a rate of ≥100° C./s, with the heat preservation time being 5-60 s, and then slow cooling is performed at 3-15° C./s to 600-750° C.

SUMMARY OF THE INVENTION

An object of the present invention lies in providing a non-oriented electrical steel plate having a good surface state, a high magnetic induction and a low iron loss, which has an ultrahigh magnetic induction, an ultralow iron loss and a better steel purity degree; moreover, the steel plate has a good surface quality without corrugated defect, and low production costs.

In order to achieve the above-mentioned object, the present invention provides a non-oriented electrical steel plate having a good surface state, a high magnetic induction and a low iron loss, with the contents of chemical elements in mass percentage being:

$0<C\leq 0.004\%$, $0.1\%\leq Si\leq 1.6\%$, $0.1\%$ $Mn\leq 0.8\%$, $0.1\%$ $Al\leq 0.6\%$, $Ti\leq 0.0015\%$, and the balance being Fe and other inevitable impurities, with $0.2\%\leq(Si+Al)\leq 2.0\%$ being met.

Inevitable impurities in the present technical solution are mainly elements N and S. As inevitable impurity elements, the contents of the impurity elements shall be as low as possible. In the non-oriented electrical steel plate having a good surface state, a high magnetic induction and a low iron loss of the present invention, in order to avoid a great increase of precipitates such as MnS, AlN to strongly hinder the grain growth and deteriorate the magnetic property of the steel, the content of S can be controlled at ≤0.003 wt. %, and the content of N can be controlled at ≤0.003 wt. %.

The design principle of the various elements in the non-oriented electrical steel plate having a good surface state, a high magnetic induction and a low iron loss of the present invention is as follows:

C: C may strongly hinder the growth of finished product grains, easily causes an increase of iron loss, produces magnetic ageing, and may further bring about difficulties for the subsequent decarburization; therefore, in the technical solution of the present invention, the content of C needs to be controlled at not higher than 0.004 wt. %.

Si: Si can improve the electrical resistivity of the matrix, to effectively reduce the iron loss of the steel. When the content of Si is higher than 1.6 wt. %, the magnetic induction of the steel may be significantly reduced; and when the content of Si is lower than 0.1 wt. %, the function of greatly reducing the iron loss cannot be affected. Therefore, with regard to the non-oriented electrical steel plate having a high magnetic induction and a low iron loss of the present invention, the content of Si needs to be controlled between 0.1-1.6 wt. %.

Mn: MnS produced by incorporating Mn with S can effectively reduce the damage to the magnetic property of the steel, and at the same time can further improve the surface state of the electrical steel plate and reduce the hot shortness of the steel plate. However, if the content of Mn in the steel plate in mass percentage is higher than 0.8%, not only is the recrystallization texture easy to be damaged, but also the manufacturing cost of producing the steel may be greatly increased. Thus, the content of Mn in the non-oriented electrical steel plate having a high magnetic induction and a low iron loss of the present invention is set between 0.1-0.8 wt. %.

Al: Al is an element for increasing the resistance, and can also be used for deep deoxidation of the electrical steel plate. However, if the content of Al is higher than 0.6 wt. %, continuous casting difficulties will be caused, significantly reducing the magnetic induction of the steel; and if the content of Al is lower than 0.1 wt. %, the solid solution temperature of AlN will be greatly reduced, causing fluctuation in magnetic property of the steel. Therefore, on the basis of the technical solution of the present invention, the addition amount of Al in the non-oriented electrical steel plate is controlled at 0.1-0.6 wt. %.

Ti: the control of element Ti is one of cores of the present technical solution. With regard to the present technical solution, Ti is not intentionally added. Since some residual element Ti may be inevitably brought in any of general steels, and the inventor found that when the content of Ti exceeds 0.0015 wt. %, the TiN inclusions may be greatly increased; as a result, the grain growth may be strongly hindered, and the magnetic property of the steel is deteriorated. Therefore, the content of element Ti in the non-oriented electrical steel plate having a high magnetic induction and a low iron loss of the present invention in mass percentage should be controlled at ≤0.0015%. This is a feature that general non-oriented electrical steel plates do not have.

Moreover, the contents of Si and Al further need to be controlled at $0.2\text{ wt. }\%\leq(Si+Al)\leq 2.0\text{ wt. }\%$, with the reasons lying in: when the content of Si+Al is lower than 0.2%, neither can the electrical resistivity of the steel plate can be effectively improved so as to reduce the iron loss of the steel plate, nor is it advantageous to control the inclusions of AlN and TiN, but magnetic performance fluctuation may also be easily caused. When the content of Si+Al is higher than 2.0%, the magnetic induction of the steel plate may be greatly reduced, and a higher content of Si and Al further easily causes problems of continuous casting difficulties, nozzle clogging and the like.

Further, the content of element Mn in the non-oriented electrical steel plate having a good surface state, a high magnetic induction and a low iron loss of the present invention in mass percentage meets:

$$Mn=k_2\times Si+k_3\times Al+a$$

wherein $k_2$=0.08-0.11, $k_3$=0.17-0.38, and a=0.1-0.4.

After the completion of decarbonization of the liquid steel, ferrosilicon, ferroaluminium and ferromanganese need to be added for an alloying treatment, and the reason why the content of element Mn in mass percentage is limited by the above-mentioned model formula is that Mn may increase the austenite phase region, such that the rate of transformation from austenite to ferrite slows, affecting the rolling stability of hot rolling. In addition, when the contents of Si and Al affect the addition amount of element Mn by the above-mentioned influence factors $k_2$ and $k_3$, element Mn can obviously improve the recrystallization temperature of a hot-rolled plate to inhibit the full crystallization of the hot-rolled plate.

Preferably, the content of Ti in the non-oriented electrical steel plate having a good surface state, a high magnetic induction and a low iron loss is controlled at ≤0.0008 wt. %.

Further strictly controlling the content of Ti in the steel can effectively avoid in the annealing process the strong inhibition effect of inclusions such as TiN in the finished steel plate on the grain growth to significantly improve the magnetic induction of the finished steel plate.

Further, in the non-oriented electrical steel plate having a good surface state, a high magnetic induction and a low iron loss of the present invention, the proportion of texture (111) distributed in the rolling direction by volume is less than 37%.

In the non-oriented electrical steel plate having a good surface state, a high magnetic induction and a low iron loss of the present invention, by a reasonable composition design of the chemical elements in the steel, the unfavorable texture (111) of the steel plate is reduced; on the one hand, the magnetic induction of the steel plate is improved by 0.028-0.070 T, and the iron loss of the steel plate is reduced by 0.23-0.49 W/kg, and on the other hand, the surface quality of the steel plate is improved, the corrugated defects in the surface of the steel plate are effectively eliminated.

Accordingly, the present invention also provides a method for manufacturing the above-mentioned non-oriented electrical steel plate having a good surface state, a high magnetic induction and a low iron loss, comprising the steps: a liquid iron pretreatment, smelting with a converter, RH refining, casting into slabs, hot rolling, acid pickling, cold rolling, annealing and coating.

It can be seen from the above-mentioned steps that as is different from the prior art, no intermediate annealing with a normalizing furnace or bell furnace is used in the method for manufacturing the above-mentioned non-oriented electrical steel plate having a good surface state, a high magnetic induction and a low iron loss of the present invention, and therefore the above-mentioned manufacturing method can greatly reduce the production costs and production time, and shortens the delivery cycle.

Further, in the step of smelting with a converter, T·Fe in ladle slag is controlled at ≥5 wt % ("T·Fe" represents the content of the total iron oxide in the steel slag, and is an expression well known to a person skilled in the art), the purpose lying in increasing the distribution ratio of Ti between slag and steel to the greatest extent, a greater distribution ratio of Ti between slag and steel means a lower content of Ti in the steel, which thus more comply with the purpose of the present case to enable the content of Ti in the steel as low as possible.

Further, in the above-mentioned step of RH refining, at the end of liquid steel decarburization and before alloying, deoxidation and alloying are performed in a sequence of first ferrosilicon and then ferroaluminium, with the addition amount of ferrosilicon per ton of steel, $M_{FeSi}$, meeting:

$$M_{Fesi}=k_1\times\{[O]_{Free}-50\}\times10^{-3}\ \text{(kg/t steel)}$$

wherein $[O]_{Free}$ is the content of free oxygen in the liquid steel at the end of decarburization in the step of RH refining; $k_1$ is a deoxidation constant, with $k_1$=1.33-1.67.

In the RH refining step, after the completion of the decarburization and before the alloying treatment, deoxidation and alloying are performed in a sequence of first ferrosilicon and then ferroaluminium in the present technical solution, rather than conventionally in a sequence of first ferroaluminium and then ferrosilicon; this is because the product produced by deoxidation and alloying in the sequence of first ferroaluminium and then ferrosilicon is cluster-shaped $Al_2O_3$, which tends to suspend in the steel and not easy to be removed, and tends to crush in the subsequent process of slab heating and rolling, such that the size of the cluster-shaped $Al_2O_3$ is reduced, but the number is increased, inhibiting the grain growth of the finished steel plate in the heat treatment process. However, the product by deoxidation and alloying in the sequence of first ferrosilicon and then ferroaluminium is merely $SiO_2$, and its particles are larger and in a spherical shape, and are easier to float up and be removed. In the present technical solution, in order to ensure a good deoxidation effect, the $[O]_{Free}$ needs to be controlled between 200-600 ppm; in addition, the amount of ferrosilicon needs to be added according to the above formula. After the addition of the ferrosilicon, it is better for the liquid steel to undergo at least 1 or 2 cycles between a vacuum groove and the steel ladle, so as to ensure the $SiO_2$ deoxidation products to fully float up. A so-called "cycle" means that the liquid steel enters into a raising pipe from the steel ladle, then enters into a lowering pipe from the raising pipe, and then returns to the steel ladle through the lowering pipe.

Furthermore, in the process of steel tapping after the completion of the step of smelting with a converter, the slag amount of the ladle top slag is controlled at 3-15 kg/ton steel.

In the process of steel tapping with a converter, the slag amount of the ladle top slag needs to be strictly controlled. When the slag amount of ladle top slag is lower than 3 kg/ton steel, the liquid steel surface tends to be exposed, leading to absorption of oxygen and nitrogen by the steel liquid, which deteriorates the purity of the liquid steel; and when the slag amount of ladle top slag is higher than 15 kg/ton steel, after the deoxidation and alloying treatment of the liquid steel, with the continuous decrease of the oxidability of the steel liquid, the distribution ratio of Ti between slag and steel will be substantially decreased, Ti in the steel slag will be reduced and enters into the liquid steel again, causing the content of Ti in the liquid steel to be excessively high and exceeding the defined range of the content. Based on the above-mentioned technical solution, a slag stopping bar or movable sliding plate can be used for slag-stopping so as to ensure that the slag amount not only can effectively cover the surface of the liquid steel, but also will not affect the normal process of RH refining.

Further, said hot rolling step comprises a step of heating before rolling, a step of at least one pass of rough rolling and a step of finish rolling, closed heat preservation is performed on slabs between a rough rolling mill stand and a finish rolling mill stand, and the inlet temperature of the finish rolling is controlled at 980-1120° C.

Performing at least 1 pass of rough rolling using two mill stands is for the purpose of crushing larger-size columnar grains. When an intermediate slab is between the rough rolling mill stand and the finish rolling mill stand, heat preservation can be performed using a closed heat preservation cover to ensure that the inlet temperature of the finish rolling is above 980° C. As such, internal grains of the intermediate slab can effectively grow, such that not only can the texture of the finished steel plate be effectively improved, but also the corrugated defects in the surface of the steel plate can be effectively eliminated.

Furthermore, in the heating step before said rolling, the temperature of the slab when removed from a furnace is controlled 1000-1150° C.

In the technical solution of the present invention, the surface quality of the finished strip steel and the content of inclusions in the steel can be strictly controlled by a reasonable composition design and improved process steps. With regard to the strict control of the surface quality of the finished strip steel, since the main reason why the corrugated defects are produced in the surface of the steel plate is that columnar grains in the slab are very developed, and cannot be fully crushed in the hot rolling process, to thereby finally form a developed texture of (111) orientation distributed in the rolling direction, so that rugged corrugated defects are produced on the surface of the strip steel.

In view of this, controlling the content of element Mn which can enlarge the austenite phase region and adding an appropriate amount of elements Si, Mn and Al can ensure forming equiaxial grains in the slab as much as possible, so as to reduce or eliminate the corrugated defects in the surface of the strip plate. In addition, adjusting the inlet temperature of the finish rolling can ensure that after the rough rolling of the slab, the crushed grain structure in the intermediate slab fully recovers and grows up, and since it has a genetic effect, in the hot-rolled strip steel after the hot rolling and finish rolling, the grain structure is coarse and developed, such that favorable textures (100) and (110) in the steel are more, and the unfavorable texture (111) in the steel is less; therefore, no corrugated defects will be present in the surface of the finished strip steel, and the steel plate has an excellent electromagnetic property. With regard to the strict control of the content of inclusions in the steel, it is required to avoid pinning of the inclusions to the grain boundary and to prevent the same from inhibiting the growth of finished grains. Since in the non-oriented electrical steel plate having a high magnetic induction and a low iron loss of the present invention, it is desired to fully grow the grains in the steel, so as to effectively reduce the iron loss of the finished strip steel, in the present technical solution, by adjustment of the RH refining and deoxidation process, a method of deoxidation and alloying in a sequence of first ferrosilicon and then ferroaluminium is used to form spherical and large-size $SiO_2$ inclusions to facilitate the inclusions to fully and rapidly float up; in addition, by strictly limiting the content of Ti to avoid producing small-size TiN inclusions which pin the grain boundary, the sizes of the finished annealed grains are thereby ensured to grow up as far as possible, thus effectively reducing the iron loss of the finished strip steel.

The non-oriented electrical steel plate of the present invention has excellent electromagnetic properties such as an ultrahigh magnetic induction, an ultralow iron loss, and as compared to the existing non-oriented electrical steel plates, the magnetic induction is improved by 0.028-0.070 T, and the iron loss is reduced by 0.23-0.49 W/kg. In addition, the non-oriented electrical steel plate of the present invention has a good surface quality, with no corrugated defect.

The non-oriented electrical steel plate of the present invention is low in production cost, and is suitable for manufacturing environmentally friendly, efficient and energy-efficient electric devices.

SPECIFIC EMBODIMENTS

The non-oriented electrical steel plate having a good surface state, a high magnetic induction and a low iron loss and the method for manufacturing the same of the present invention are further explained and illustrated below combined with the accompanying drawings of the description and particular embodiments. However, the explanation and illustration do not form an inappropriate limit to the technical solution of the present invention.

Figure 1:
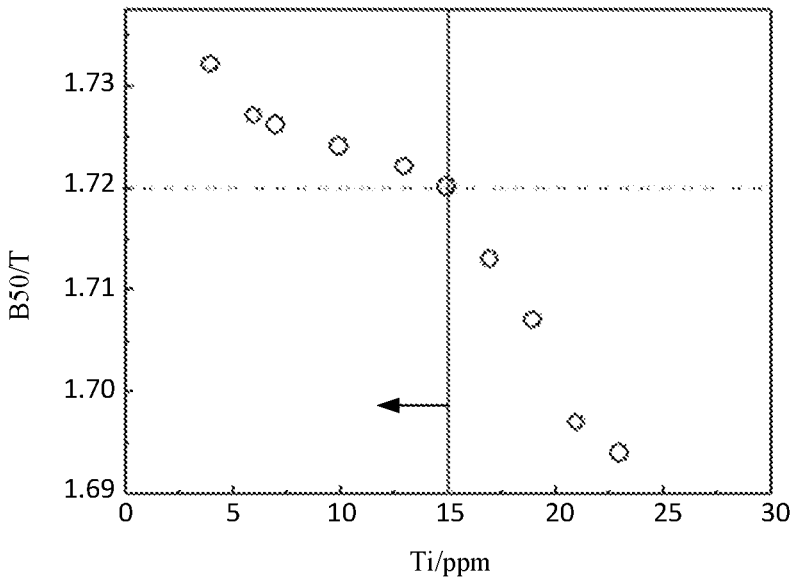
FIG. 1 is a graph of the relation between the content of Ti in the non-oriented electrical steel plate having a good surface state, a high magnetic induction and a low iron loss of the present invention and the magnetic induction of the finished steel plate.

FIG. 1 shows the relation between the content of Ti in the non-oriented electrical steel plate having a good surface state, a high magnetic induction and a low iron loss of the present invention and the magnetic induction of the finished steel plate.

On the basis of the technical solution of the present invention, it is demonstrated by the inventor through experiments that the lower the content of Ti in the steel is controlled, the higher the magnetic induction in the obtained steel plate. As shown in FIG. 1, when the content of Ti is ≤15 ppm, the magnetic induction of the steel plate is 1.72 T, and when the content of Ti is >15 ppm, the magnetic induction of the steel plate is greatly reduced, especially when the content of Ti exceeds 20 ppm, the magnetic induction of the steel plate is less than 1.70 T.

Figure 2:
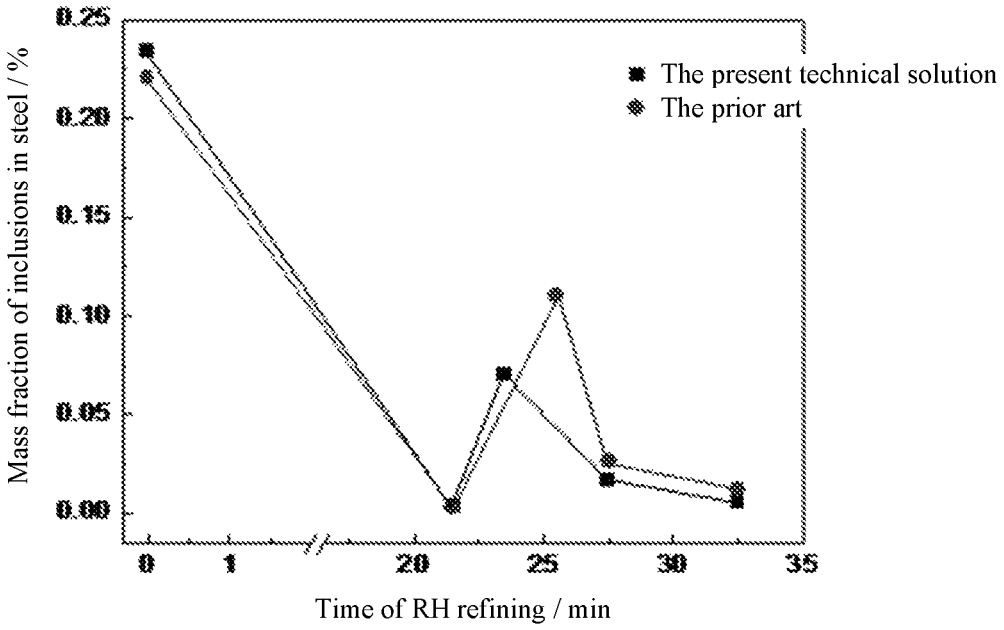
FIG. 2 is a graph of comparison of the ferrosilicon deoxidation used in the method for manufacturing the non-oriented electrical steel plate having a good surface state, a high magnetic induction and a low iron loss of the present invention and the ferroaluminium deoxidation used in the prior art.

FIG. 2 is a graph of comparison of the ferrosilicon deoxidation used in the method for manufacturing the non-oriented electrical steel plate having a good surface state, a high magnetic induction and a low iron loss of the present invention and the ferroaluminium deoxidation used in the prior art.

As shown in FIG. 2, with regard to steel plates respectively where the method of deoxidation and alloying in a sequence of first ferrosilicon and then ferroaluminium and the method of deoxidation and alloying in a sequence of first ferroaluminium and then ferrosilicon are used, after a refining time of not less than 20 min, the content of inclusions in the plate obtained by the method of deoxidation and alloying in a sequence of first ferrosilicon and then ferroaluminium used in the present case is obviously less than the content of inclusions in the plate obtained by the method of deoxidation and alloying in a sequence of first ferroaluminium and then ferrosilicon used in the prior art.

Figure 3:
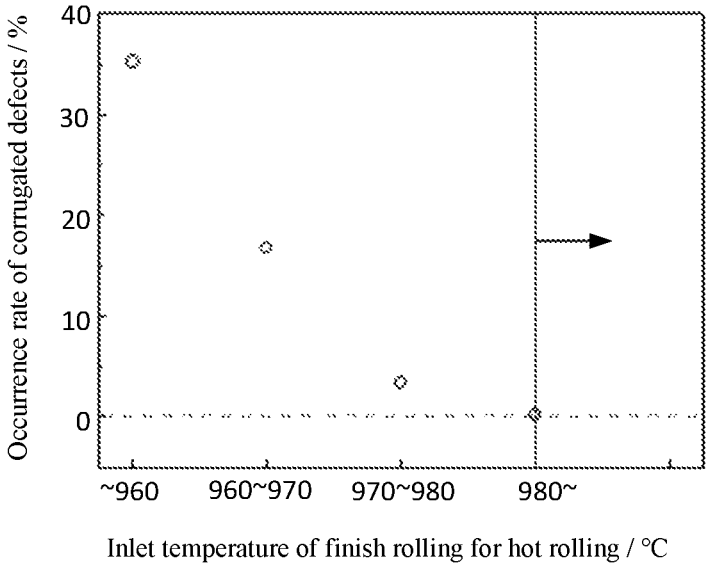
FIG. 3 is a graph of the relation between the controlled inlet temperature of the finish rolling in the method for manufacturing the non-oriented electrical steel plate having a good surface state, a high magnetic induction and a low iron loss of the present invention and the occurrence rate of corrugated defects in the surface of the steel plate.

FIG. 3 shows the relation between the controlled inlet temperature of the finish rolling in the method for manufacturing the non-oriented electrical steel plate having a good surface state, a high magnetic induction and a low iron loss of the present invention and the occurrence rate of corrugated defects in the surface of the steel plate.

As shown in FIG. 3, when the inlet temperature of the finish rolling is controlled at ≥980° C., it can be seen that the occurrence rate of the corrugated defects in the surface of the steel plate is 0, and once the inlet temperature of the finish rolling is controlled at <980° C., the occurrence rate of the corrugated defects in the surface of the steel plate will increase with the decrease of the inlet temperature of the finish rolling.

Figure 4:
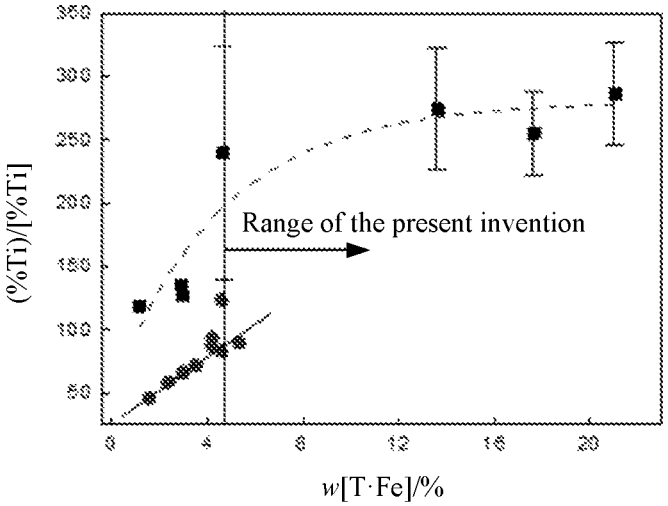
FIG. 4 shows the relation between the content of T·Fe of ladle slag in the method for manufacturing the non-oriented electrical steel plate having a good surface state, a high magnetic induction and a low iron loss of the present invention and the distribution ratio of Ti between slag and steel.

FIG. 4 shows the relation between the content of T·Fe of ladle slag in the method for manufacturing the non-oriented electrical steel plate having a good surface state, a high magnetic induction and a low iron loss of the present invention and the distribution ratio of Ti between slag and steel.

As shown in FIG. 4, when the content of T·Fe of ladle slag is ≥5%, it can be seen that the distribution ratio of Ti between slag and steel can be greater than 200, and when the content of T·Fe of ladle slag is <5%, the distribution ratio of Ti between slag and steel can be greatly decreased with the decrease of the content of T·Fe in the ladle slag.

Examples A1-A10 and Comparative Examples B1-B11

The components of the steel plates in Examples A1-A10 of the present case are as shown in table 1; in addition, table 1 also lists the components of those in Comparative Examples B1-B11.

The steel plates in Examples A1-A10 are manufactured according to the following steps:

1) Pre-treating liquid iron;

2) Smelting with a converter: after the smelting with a converter, a technique of twice slag-stopping is used, wherein a slag stopping bar or movable sliding plate can be used for slag-stopping, the slag amount of the ladle top slag being controlled at 3-15 kg/ton steel, and the T·Fe in ladle slag being controlled at ≥5 wt %;

3) RH refining: at the end of liquid steel decarburization and before alloying, a method of deoxidation and alloying in a sequence of first ferrosilicon and then ferroaluminium is used, with the addition amount of ferrosilicon per ton of steel, $M_{FeSi}$, meeting: $M_{FeSi}=k_1\times\{[O]_{Free}-50\}\times10^{-3}$ (kg/t steel), wherein $[O]_{Free}$ is the content of free oxygen in the liquid steel at the end of decarburization in the step of RH refining; $k_1$ is a deoxidation constant, with $k_1$=1.33-1.67, the addition amount of ferroaluminium is an amount allowing the content of Al in the present case to meet the composition as listed in table 1 (with regard to the Comparative Examples, due to the addition of first ferroaluminium and then ferrosilicon, the addition amount of ferroaluminium is a content allowing the content of element Si in the Comparative Example to meet that as listed in table 1);

4) Smelting and casting into blanks;

5) Hot rolling: the hot rolling step comprises a step of heating before rolling, a step of at least one pass of rough rolling and a step of finish rolling, wherein in the step of heating before rolling, the temperature of the slab when removed from a furnace is controlled at 1000-1150° C., and closed heat preservation is performed on intermediate slabs between a rough rolling mill stand and a finish rolling mill stand, and the inlet temperature of the finish rolling is controlled at 980-1120° C.;

6) Acid pickling;

7) Cold rolling;

8) Annealing; and

9) Coating.

Reference is made in detail to table 2 for specific process parameters in the above-mentioned manufacturing method and various steps involved.

Table 1 lists the contents of various chemical elements in the steel plates of Examples A1-A10 and Comparative Examples B1-B11 in mass percentage.

TABLE 1

(wt. %, the balance being Fe and other inevitable impurities other than elements S and N)

| Serial number | C | Si | Mn | Al | Ti | Si + Al | $Mn = k_2 \times Si + k_3 \times Al + a$ $k_2$ | $k_3$ | a |
|---|---|---|---|---|---|---|---|---|---|
| A1 | 0.0018 | 0.27 | 0.18 | 0.27 | 0.0007 | 0.54 | 0.09 | 0.18 | 0.11 |
| A2 | 0.0039 | 0.3 | 0.24 | 0.29 | 0.0005 | 0.59 | 0.11 | 0.17 | 0.16 |
| A3 | 0.0027 | 0.26 | 0.32 | 0.29 | 0.0013 | 0.55 | 0.08 | 0.38 | 0.19 |
| A4 | 0.0024 | 0.28 | 0.28 | 0.28 | 0.0009 | 0.56 | 0.08 | 0.2 | 0.2 |
| A5 | 0.0022 | 1.27 | 0.39 | 0.41 | 0.0009 | 1.55 | 0.08 | 0.3 | 0.17 |
| A6 | 0.0014 | 1.31 | 0.35 | 0.32 | 0.0012 | 1.58 | 0.11 | 0.28 | 0.12 |
| A7 | 0.0019 | 1.32 | 0.26 | 0.29 | 0.0004 | 1.61 | 0.08 | 0.18 | 0.1 |
| A8 | 0.0038 | 1.26 | 0.24 | 0.22 | 0.0006 | 1.55 | 0.08 | 0.17 | 0.1 |
| A9 | 0.0016 | 1.32 | 0.58 | 0.26 | 0.0007 | 1.58 | 0.11 | 0.32 | 0.35 |
| A10 | 0.0029 | 1.44 | 0.62 | 0.38 | 0.0006 | 1.82 | 0.08 | 0.28 | 0.4 |
| B1 | 0.0031 | 0.27 | 0.36 | 0.28 | 0.0028 | / | / | / | / |
| B2 | 0.0022 | 0.26 | 0.34 | 0.29 | 0.0007 | / | / | / | / |
| B3 | 0.0034 | 0.27 | 0.28 | 0.32 | 0.0009 | / | / | / | / |
| B4 | 0.0019 | 1.25 | 0.27 | 0.26 | 0.0008 | / | / | / | / |
| B5 | 0.0025 | 1.28 | 0.62 | 0.30 | 0.0006 | / | / | / | / |
| B6 | 0.0019 | 1.26 | 0.19 | 0.28 | 0.0021 | / | / | / | / |
| B7 | 0.0024 | 1.44 | 0.48 | 0.58 | 0.0009 | / | / | / | / |
| B8 | 0.0027 | 1.38 | 0.92 | 0.32 | 0.0014 | / | / | / | / |
| B9 | 0.0026 | 1.37 | 0.22 | 0.29 | 0.0018 | / | / | / | / |
| B10 | 0.0024 | 1.38 | 0.24 | 0.28 | 0.0008 | / | / | / | / |
| B11 | 0.0018 | 1.40 | 0.22 | 0.27 | 0.0024 | / | / | / | / |

Table 2 lists the process parameters of the method for manufacturing the steel plates of Examples A1-A10 and Comparative Examples B1-B11 in mass percentage.

TABLE 2

| Serial number | RH refining: Deoxidation method* | RH refining: Addition amount $M_{FeSi} = k_1 \times \{[O]_{Free} - 50\} \times 10^{-3}$ (kg/t steel) | Smelting with a converter: Content of T•Fe in ladle slag | Steel tapping after smelting with a converter: Slag amount of the ladle top slag (kg/ton steel) | Heating: Temperature when removed from furnace (° C.) | Rough rolling: Rough rolling pass | Precision rolling: Inlet temperature of finish rolling (° C.) |
|---|---|---|---|---|---|---|---|
| A1 | First ferrosilicon and then ferroaluminium | 1.40 × 0.402 | 6.3 | 7.1 | 1132 | 3 | 1002 |
| A2 | First ferrosilicon and then ferroaluminium | 1.33 × 0.301 | 10.9 | 3.5 | 1146 | 3 | 981 |
| A3 | First ferrosilicon and then ferroaluminium | 1.60 × 0.546 | 5.7 | 5.4 | 1115 | 3 | 994 |

TABLE 2-continued

| Serial number | RH refining: Deoxidation method* | RH refining: Addition amount $M_{FeSi} = k_1 \times \{[O]_{Free} - 50\} \times 10^{-3}$ (kg/t steel) | Smelting with a converter: Content of T•Fe in ladle slag | Steel tapping after smelting with a converter: Slag amount of the ladle top slag (kg/ton steel) | Heating Temperature when removed from furnace (° C.) | Rough rolling: Rough rolling pass | Precision rolling: Inlet temperature of finish rolling (° C.) |
|---|---|---|---|---|---|---|---|
| A4 | First ferrosilicon and then ferroaluminium | 1.47 × 0.428 | 8.8 | 10.2 | 1126 | 3 | 984 |
| A5 | First ferrosilicon and then ferroaluminium | 1.40 × 0.373 | 19.2 | 9.2 | 1090 | 3 | 994 |
| A6 | First ferrosilicon and then ferroaluminium | 1.53 × 0.521 | 7.1 | 14.3 | 1149 | 3 | 1114 |
| A7 | First ferrosilicon and then ferroaluminium | 1.37 × 0.255 | 11.4 | 7.8 | 1117 | 3 | 984 |
| A8 | First ferrosilicon and then ferroaluminium | 1.33 × 0.239 | 8.2 | 6.9 | 1070 | 3 | 992 |
| A9 | First ferrosilicon and then ferroaluminium | 1.47 × 0.338 | 5.4 | 8.2 | 1122 | 3 | 984 |
| A10 | First ferrosilicon and then ferroaluminium | 1.47 × 0.377 | 11.3 | 12.8 | 1135 | 3 | 1003 |
| B1 | First ferrosilicon and then ferroaluminium | 1.60 × 0.464 | 3.5 | 15.2 | 1158 | 3 | 953 |
| B2 | First ferrosilicon and then ferroaluminium | 1.40 × 0.207 | 2.1 | 8.4 | 1114 | 3 | 961 |
| B3 | First ferroaluminium and then ferrosilicon | / | 2.8 | 10.2 | 1132 | 3 | 972 |
| B4 | First ferrosilicon and then ferroaluminium | 1.47 × 0.377 | 4.7 | 2.8 | 1100 | 3 | 971 |
| B5 | First ferrosilicon and then ferroaluminium | 1.64 × 0.537 | 6.8 | 6.9 | 1140 | 3 | 968 |
| B6 | First ferroaluminium and then ferrosilicon | / | 8.7 | 9.4 | 1127 | 3 | 954 |
| B7 | First ferrosilicon and then ferroaluminium | 1.53 × 0.261 | 2.2 | 11.2 | 1119 | 3 | 969 |
| B8 | First ferrosilicon and then ferroaluminium | 1.53 × 0.539 | 3.1 | 8.5 | 1134 | 3 | 997 |
| B9 | First ferroaluminium and then ferrosilicon | / | 4.4 | 5.6 | 1080 | 3 | 955 |
| B10 | First ferrosilicon and then ferroaluminium | 1.57 × 0.323 | 4.1 | 12.4 | 1125 | 3 | 953 |
| B11 | First ferrosilicon and then ferroaluminium | 1.46 × 0.193 | 1.8 | 6.3 | 1137 | 3 | 1017 |

Table 3 lists the electromagnetic properties and texture parameters of the steel plates in Examples A1-A10 of the present case and Comparative Examples B1-B11.

TABLE 3

| Serial number | Iron loss (W/kg) | Magnetic induction (T) | Surface state of steel plate |
|---|---|---|---|
| A1 | 5.52 | 1.78 | √ |
| A2 | 5.48 | 1.76 | √ |
| A3 | 5.52 | 1.76 | √ |
| A4 | 5.61 | 1.76 | √ |
| A5 | 3.75 | 1.73 | √ |
| A6 | 3.68 | 1.73 | √ |
| A7 | 3.72 | 1.73 | √ |
| A8 | 3.78 | 1.72 | √ |
| A9 | 3.70 | 1.71 | √ |
| A10 | 3.59 | 1.70 | √ |
| B1 | 6.18 | 1.73 | x |
| B2 | 5.76 | 1.74 | x |
| B3 | 6.11 | 1.74 | x |
| B4 | 4.26 | 1.68 | x |
| B5 | 3.84 | 1.67 | x |
| B6 | 4.17 | 1.68 | x |
| B7 | 3.68 | 1.66 | x |
| B8 | 3.58 | 1.67 | √ |
| B9 | 3.99 | 1.69 | x |
| B10 | 3.92 | 1.70 | x |
| B11 | 3.98 | 1.69 | √ |

NOTE*:
"√" represents that the surface state is good; and "x" represents that the surface has corrugated defects.

It can be seen from table 3 that, the magnetic inductions in Comparative Examples B1-B3 are higher than 1.70 T, but the iron losses is also high; the iron losses in Comparative Examples B4-B9 and B 11 are decreased, but the magnetic inductions are also decreased simultaneously; and the iron loss in Comparative Example B10 is lower, and the magnetic induction also reaches 1.70 T, but the surface has corrugated defects. However, in the non-oriented electrical steel plates of Examples A1-A10 of the present case, the magnetic inductions are all ≥1.70 T, and the iron losses are all ≤5.61 W/kg; in addition, no corrugated defect is present in the surfaces of the steel plates, i.e., achieving having a high magnetic induction, a low iron loss and a good surface quality at the same time. It can be seen therefrom that the non-oriented electrical steel plate of the present invention further has a good surface quality in addition to having an ultrahigh magnetic induction and an ultralow iron loss, and can be suitable for manufacturing environmentally friendly, efficient and energy-efficient electric devices such as EI iron cores, electric motors, small-sized transformers.

It should be noted that the examples listed above are only the specific examples of the present invention, and obviously the present invention is not limited to the above examples and can have many similar changes. With regard to all variants, if directly derived or conceived from the contents disclosed in the present invention by a person skilled in the art, they shall all fall within the scope of protection of the present invention.

The invention claimed is:

1. A method for manufacturing a non-oriented electrical steel plate comprising the steps of: pre-treating liquid iron, smelting with a converter, tapping, Ruhrstahl-Heraeus (RH) molten steel off-furnace refining, casting into slabs, hot rolling, acid pickling, cold rolling, annealing and coating;

wherein in the step of smelting with a converter, a total iron oxide content (T.Fe) in ladle slag is controlled to be ≥5 wt %;

wherein in the process of tapping following the step of smelting with a converter, a slag amount of ladle top slag is controlled at 3-15 kg/ton steel;

wherein in the step of RH refining, after liquid steel decarburization and before alloying, deoxidation and alloying are performed in a sequence of first ferrosilicon and then ferroaluminium, with an addition amount of ferrosilicon per ton of steel $M_{FeSi}$ calculated as:

$$M_{FeSi}=K_1\times\{[O]_{Free}-50\}\times10^{-3}\ \text{(kg/t steel)}$$

wherein $[O]_{Free}$ refers to free oxygen in the liquid steel after decarburization; and $k_1$ refers to a deoxidation constant which is 1.33-1.67;

wherein said hot rolling step comprises a step of heating before rolling, said rolling comprising a step of at least one pass of rough rolling and a step of finish rolling, and closed heat preservation is performed on slabs between a rough rolling mill stand and a finish rolling mill stand, and an inlet temperature of the finish rolling is controlled at 980-1120° C.;

wherein the non-oriented electrical steel plate has chemical composition in mass percentage being: 0<C≤0.004%, 0.1%≤Si≤1.6%, 0.1%≤Mn≤0.8%, 0.1%≤Al≤0.6%, Ti≤0.0015%, and the balance being Fe and other inevitable impurities, with 0.2%≤(Si+Al)≤2.0% being met; and wherein no corrugated defect is present on surfaces of the non-oriented electrical steel plate, and wherein the non-oriented electrical steel plate has a magnetic induction of greater than or equal to 1.70 T and an iron loss of less than or equal to 5.61 W/kg.

2. The manufacturing method of claim 1, wherein in the step of heating before hot rolling, the temperature of the slab when removed from a furnace is controlled at 1000-1150° C.

3. The manufacturing method of claim 1, wherein the content of element Mn in mass percentage is:

$$Mn=k_2\times Si+k_3\times Al+a$$

wherein $k_2$=0.08-0.11, $k_3$=0.17-0.38, and a=0.1-0.4.

4. The manufacturing method of claim 1, wherein Ti≤0.0008%.

5. The manufacturing method of claim 1, wherein a proportion of texture (111) distributed in the rolling direction by volume is less than 37%.

* * * * *